US005123205A

United States Patent [19]

Folkerts

[11] Patent Number: 5,123,205

[45] Date of Patent: Jun. 23, 1992

[54] INSPECTION DOOR FOR GRAIN HANDLING EQUIPMENT

[76] Inventor: Cornie Folkerts, c/o Inwood Machine, Rte. 2, Box 43, Inwood, Iowa 51240

[21] Appl. No.: 711,205

[22] Filed: Jun. 6, 1991

[51] Int. Cl.[5] ..... E05C 21/02

[52] U.S. Cl. ..... 49/465; 49/394; 52/196

[58] Field of Search ..... 49/394, 463, 465; 52/196, 192

[56] References Cited

U.S. PATENT DOCUMENTS

| | | | |
|---|---|---|---|
| 1,247,186 | 11/1917 | Wampach | 49/394 X |
| 1,381,894 | 6/1921 | Stafford | 49/463 X |
| 3,340,650 | 9/1967 | Sackett, Sr. | 49/463 |
| 3,461,607 | 8/1969 | Sandow et al. | 49/394 X |
| 3,918,204 | 11/1975 | Lynch et al. | 49/394 X |
| 4,224,770 | 9/1980 | Petty | 52/192 X |

*Primary Examiner*—Philip C. Kannan
*Attorney, Agent, or Firm*—Wood, Phillips, Van Santen, Hoffman & Ertel

[57] ABSTRACT

A closure assembly selectively closes an access opening for an enclosure having walls defining an interior space. The closure assembly includes a pair of hinges mounted to the one wall on opposite sides of the opening, the hinges having aligned apertures therethrough spaced outwardly from the one wall. A rectangular sheet metal door of a size larger than the opening is formed in a generally pyramid configuration having four creases, each extending from the centerpoint to one of the corners of the door. The centerpoint defines an apex of the pyramid configuration. Each side edge of the door between adjacent corners has a downward convex curve. The door is positioned in overlying relationship with the opening to completely cover the same with the apex disposed intermediate the hinges. A cam rod has a central, overcentered cam between opposite end rods rotatably and removably received in the hinge openings and a handle operatively associated with the cam. Rotation of the cam by the handle causes the cam to apply pressure to the apex of the door and through the creases to the curved side edges to provide an even seal of the door about the opening.

15 Claims, 3 Drawing Sheets

INSPECTION DOOR FOR GRAIN HANDLING EQUIPMENT

FIELD OF THE INVENTION

This invention relates to a closure assembly and, more particularly, to an inspection door for providing access to grain handling equipment.

BACKGROUND OF THE INVENTION

Grain handling companies use grain storage bins incorporated into their facilities. A grain leg is used to carry grain to the top of the structure to deposit the grain into the bins. A grain leg is made up of two large pulleys, one at the top and one at the bottom. A flat belt runs over the two pulleys upon which are attached cups to carry the grain. When the cups reach the top, they go over the pulley and start back down. The grain is spilled out into a spout and into the storage bin. All of the above-described apparatus is enclosed in a metal enclosure. An inspection opening is needed to gain access to the inside working parts of the grain leg enclosure.

During normal use, it is necessary that the access opening be closed. A closure in the form of a hinged door is typically used. Such doors are disadvantageous in that even when fully opened they can interfere with a user attempting to gain access to the interior component parts. Further, it is necessary that such doors provide a seal to prevent dust release from the interior of the enclosure.

The disclosed invention is intended to solve one or more of the problems set forth above in a novel and simple manner.

SUMMARY OF THE INVENTION

In accordance with the invention there is disclosed a closure assembling including a door for covering an opening and a cam rod effective to seal an outer edge of the door about the opening.

Broadly, there is disclosed a closure assembly used for an enclosure having walls defining an interior space and an access opening through one wall providing access to the space. The closure assembly includes a pair of hinges mounted to the one wall on opposite sides of the opening, the hinges having aligned apertures therethrough spaced outwardly from the one wall. A door is provided of a size larger than the opening and formed in a generally pyramid configuration having a plurality of creases angularly spaced about a centerpoint. The centerpoint defines an apex of the pyramid configuration. The door is positioned in overlying relationship with the opening to completely cover the same with the apex disposed intermediate the hinges. A cam rod having a central, overcentered cam is provided between opposite end rods rotatably received in the hinge openings and a handle operatively associated with the cam so that rotation of the cam by the handle causes the cam to apply pressure to the apex of the door and through the creases to seal an outer edge of the door about the opening.

It is a feature of the invention that the cam rod comprises an elongate rod double bent at each side between a centerpoint and ends defining said end rods, a portion of the rod between the bends defining the cam.

It is another feature of the invention that a pressure pad is provided in the form of a plate secured to the door at the apex to be acted upon by the cam.

It is a further feature of the invention to provide a pair of retaining brackets secured to the door on opposite sides of the apex for retaining the cam rod with the door with the cam disposed between the retaining brackets.

It is still another feature of the invention that the outer periphery of the door is generally square.

There is disclosed in accordance with another aspect of the invention a closure assembly in an enclosure having walls defining an interior space and an access opening through one wall providing access to the space. The closure assembly includes a pair of hinges mounted to the one wall on opposite sides of the opening, the hinges having aligned apertures therethrough spaced outwardly from the one wall. A rectangular sheet metal door of a size larger than the opening is formed in a generally pyramid configuration having four creases, each extending from the centerpoint to one corner of the door. The centerpoint defines an apex of the pyramid configuration. Each side edge of the door between adjacent corners has a downward convex curve. The door is positioned in overlying relationship with the opening to completely cover the same with the apex disposed intermediate the hinges. A cam rod has a central, overcentered cam between opposite end rods rotatably and removably received in the hinge openings and a handle operatively associated with the cam. Rotation of the cam by the handle causes the cam to apply pressure to the apex of the door and through the creases to the curved side edges to provide an even seal of the door about the opening.

Further features and advantages of the invention will readily be apparent from the specification and from the drawings.

DETAILED DESCRIPTION OF THE INVENTION

Figure 1:
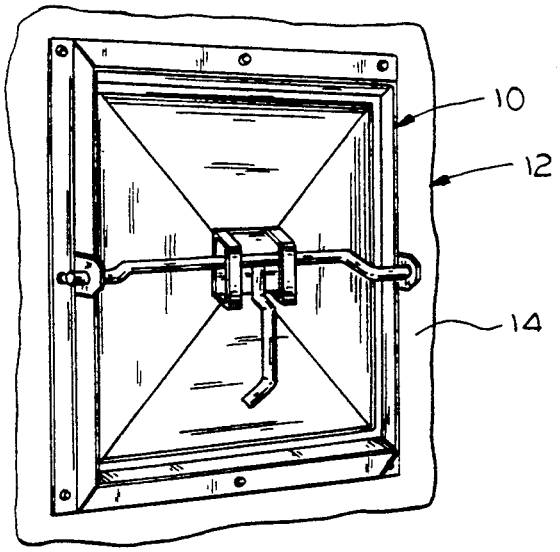
FIG. 1 is a partial perspective view of a grain elevator leg including a closure assembly according to the invention with a door in a fully closed position.
Figure 2:
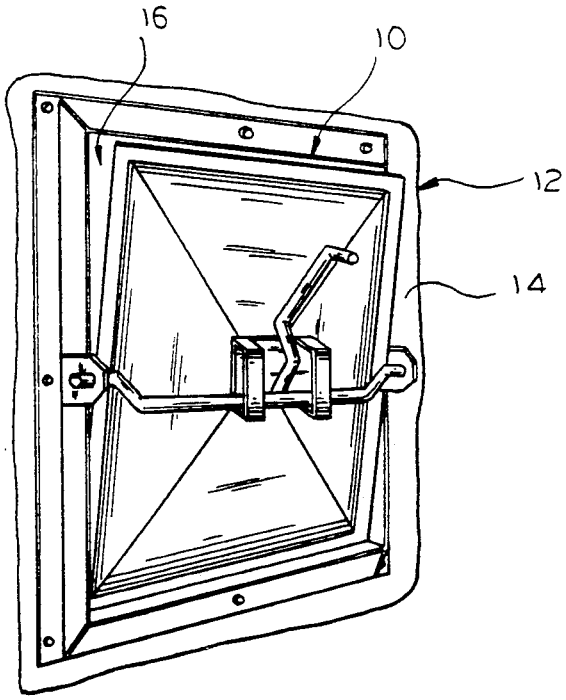
FIG. 2 is a view similar to that of FIG. 1 showing the door in a partially open position.
Figure 3:
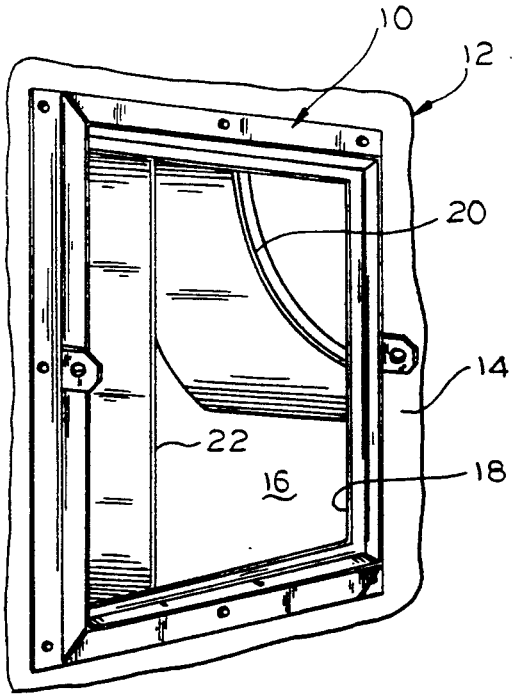
FIG. 3 is a view similar to that of FIG. 1 showing the door completely removed from an access opening.

With reference to FIGS. 1-3, a door closure assembly 10 is illustrated in connection with an enclosure 12. The enclosure includes walls, one of which, 14, is illustrated, defining an interior space 16, see FIG. 3, and an access opening 18 providing access to said space 16. In the illustrated embodiment of the invention, the enclosure 12 is an enclosure for a grain handling leg. The opening 18 provides access to a pulley 20 and belt 22 received on the pulley 20. The access opening 18 provides access to service of the pulley 20 and belt 22 as well as any other components included in the grain handling leg and not specifically shown herein.

Although the closure assembly 10 is illustrated in connection with the enclosure 12 for a grain handling leg, the closure assembly 10 could be used in connection with any enclosure having an access opening and requiring a sealed inspection door therefor.

Figure 4:
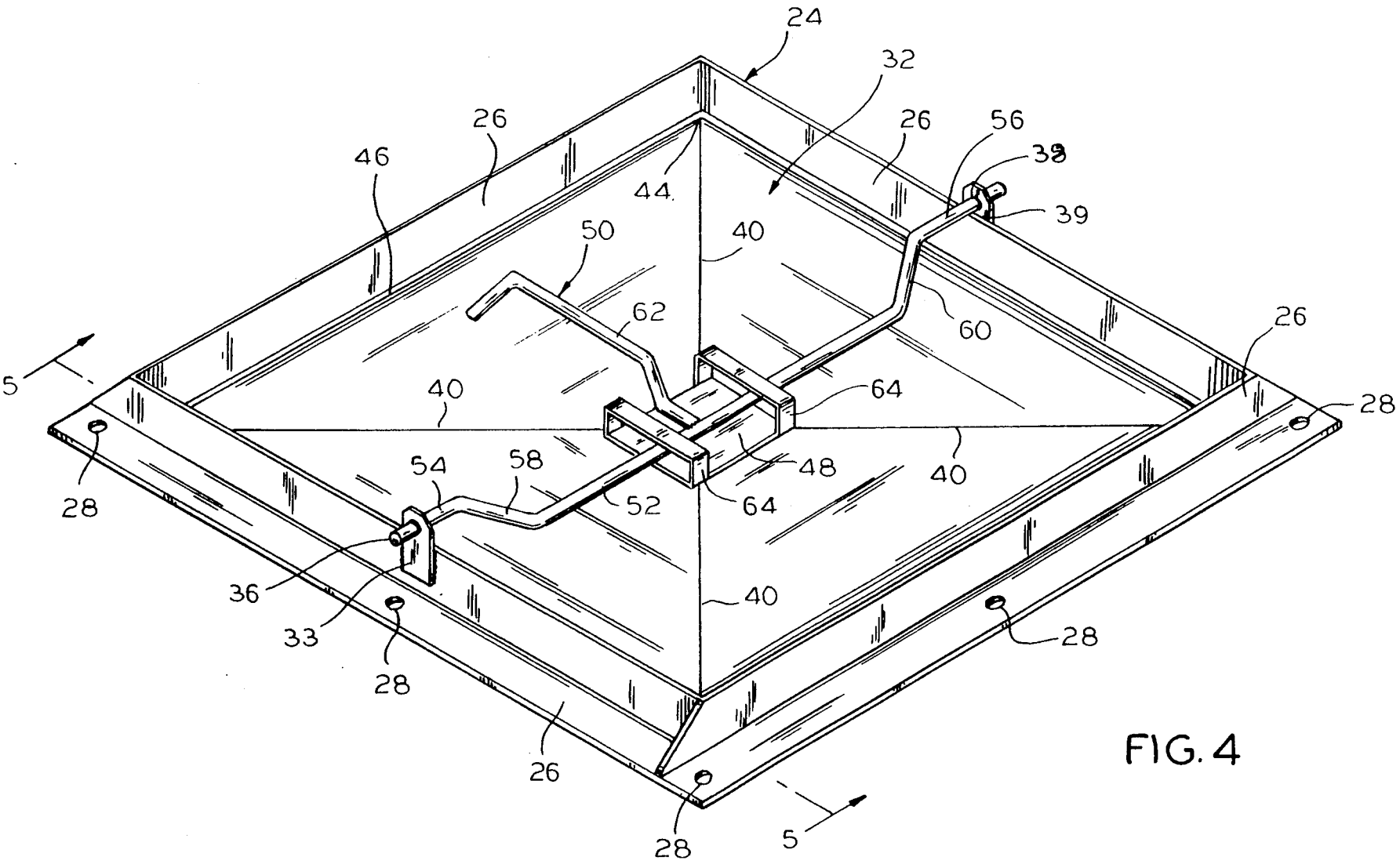
FIG. 4 is an enlarged perspective view showing the closure assembly of FIG. 1.
Figure 5:
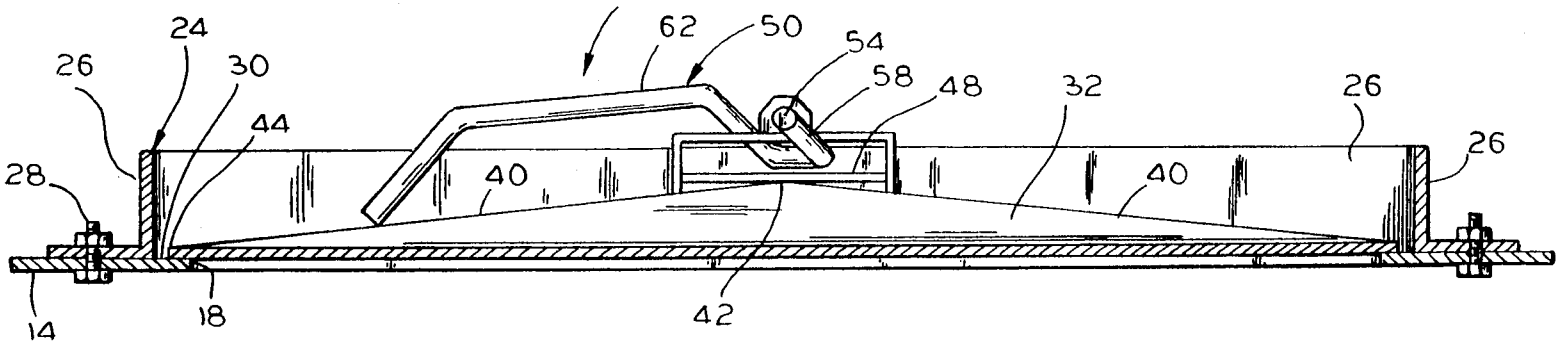
FIG. 5 is a sectional view taken along the line 5—5 of FIG. 4 with the door in a fully closed position.
Figure 6:
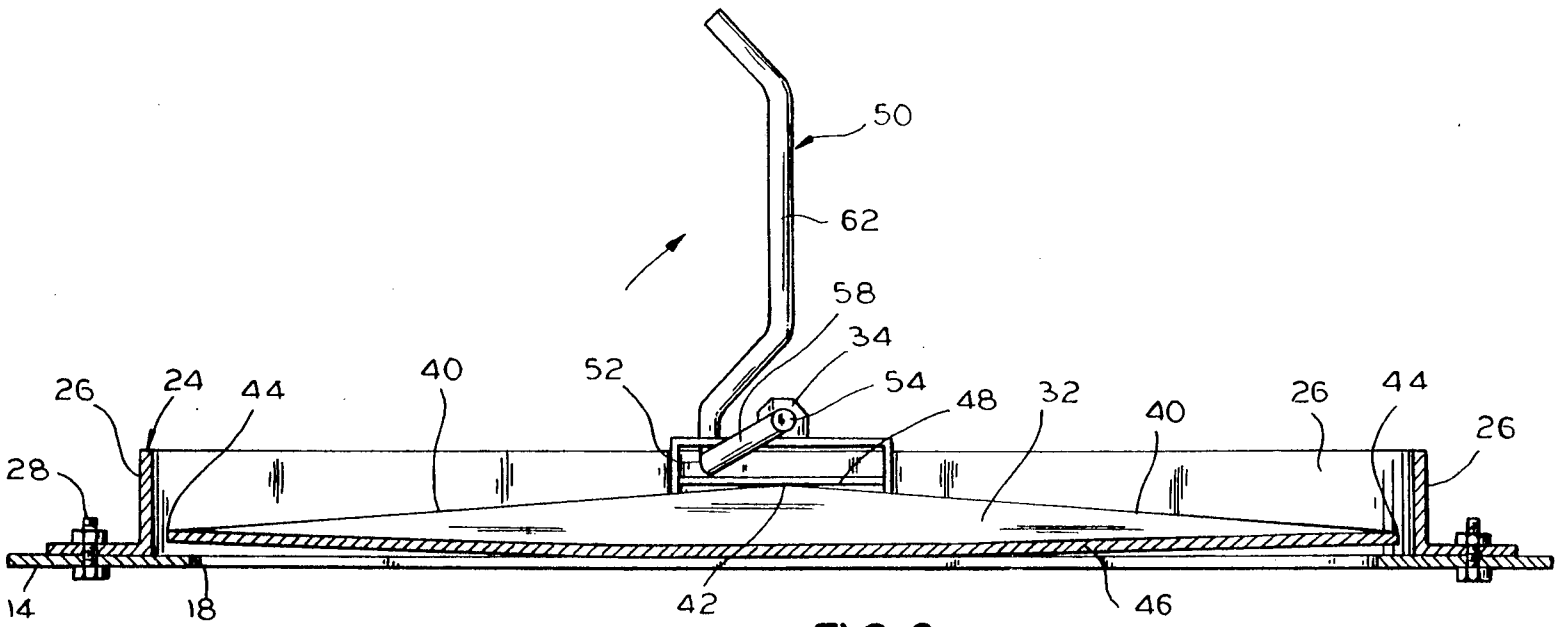
FIG. 6 a sectional view similar to that of FIG. 5 showing the d in the partially open position.

With reference to FIGS. 4–6, the opening 18 is generally rectangular and is, in fact, square, although the shape of the opening 18 is not important A square angle iron frame 24 is secured to the wall 14 about the opening 18. Particularly, the frame 24 comprises four equal lengths 26 of angle iron fastened to the enclosure wall 14 using bolts 28. The angle iron lengths 26 may be, for example, one-eighth inch thick with legs one and one-half inch for doors over fourteen inch square and one inch for doors less than fourteen inch square, as necessary. The frame 24 is mounted in place around the opening 18 which is one inch less dimensionally than the inside measurement of the frame 24. This provides a one-half inch lip 30 completely surrounding the opening 18 for an access door 32 to rest against.

A pair of hinges 33 and 34 are mounted to the frame 24, and thus the enclosure wall 14, on opposite sides of the opening 18. Each hinge 33 and 34 comprises a flat metal plate including a circular through aperture 36 and 38, respectively. The hinges 33 and 34 are mounted with the apertures 36 and 38 in coaxial alignment with one another and spaced outwardly from the wall 14.

The door 32 comprises a rectangular, or square in the illustrated embodiment, sheet metal door of a size larger than the opening 18. The door 32 is formed in a generally pyramid configuration having four creases 40 each extending from a centerpoint 42 to one of the four corners 44. The centerpoint 42 defines an apex of the pyramid configuration. The door includes side edges 46 between adjacent corners 44. As illustrated particularly in FIG. 6, each side edge 56 has a downward convex curve.

A pressure pad comprising a plate 48 is mounted to the outside of the door 32 at the apex 42. The plate 48 may be secured as by welding or any other known means to the door 32.

A cam rod 50 is used for securing the door 32 to the enclosure 14 via the hinges 33 and 34. The cam rod 50 has a central, overcentered cam portion 52 between opposite end rods 54 and 56. In accordance with the invention, the end rods 54 and 56 and cam 52 comprise a single elongate rod double bent as at 58 and 60 between the central cam portion 52 and the end rod portions 54 and 56. As a result of such bending, the end rods 54 and 56 are coaxially aligned with one another and in spaced parallel relation with an axis of the central portion defining the cam 52. A handle 62 is fastened by any known means, such as welding, to the cam 52.

To maintain the cam rod 50 in assembled relation with the door 32, a pair of retaining bars 64 is secured to the pressure pad 48 on opposite sides. The cam 52 extends through the retaining bar 64 with the handle 62 connected intermediate the retaining bar 64 to prevent removal of the cam rod 50 from the door 32.

To install the door 32 to the enclosure 14, the door 32 is positioned inside of the frame 24, as shown in FIG. 6, with the handle 62 generally perpendicular to the door 32. With the handle 62 in such position, the cam 52 is slightly elevated from the pressure pad 48. Subsequently, the end rods 54 and 56 can be inserted in the hinge openings 36 and 38, respectively, by suitably manipulating the position of the cam rod 50 back and forth, as should be apparent In order to lock and seal the door 32, the handle 62 is turned counterclockwise, as indicated by the arrow in FIG. 5. As the cam rod 50 rotates, the axis of the cam 52 swings through an arc about the axis of the end rods 54 and 56 and subsequently engages and provides pressure on the pressure pad 48 and therethrough to the apex 42. The door 32 being of sheet metal has resilience or springiness. The pressure applied at the apex 42 is subsequently applied to the corners 44. Particularly, the creases, or sharp bends, 40, transfer pressure from the apex 42 to each corner 44. This is due to the fact that sheet metal becomes very stiff in the area of a sharp bend or crease. By preforming the side edges 46 to have a downward convex curve, when the door is placed against the lip 30 the area midway between the corners 44 makes contact first. As pressure is applied to the apex 42 the curved side edges 46 become straight when the corners 44 reach the lip 30 to be sealed thereagainst. This provides a tight seal. As the handle 62 is advanced all the way down to the position illustrated in FIG. 5, the cam 52 is overcentered and locks in position.

To subsequently remove the door, the handle 62 is raised, as illustrated by the arrow in FIG. 6 at which time the door 32 can be removed by reversing the process for installing the same.

Thus, in accordance with the invention, a closure assembly is provided including a door having a pyramid shape which transfers pressure from the center to outside corners. Further, pressure is transferred from the corners to the midpoint on each side edge because of the curved shape of each side edge. Pressure remains substantially constant because of the resilience of steel. Owing to the above described relationships, the door becomes its own spring, allowing the cam to work properly and to hold the handle in a closed position after the cam is slightly overcentered.

Although not shown, the door 32 may include a gasket or rubber seal around the inside edge of the door to provide an even better seal.

The door 32 can be made from hot or cold rolled sheet metal (A-36 sixteen gauge), as well as from stainless steel or other similar materials.

I claim:

1. In an enclosure having walls defining an interior space and an access opening through one wall providing access to said space, a closure assembly comprising:

a pair of hinges mounted to said one wall on opposite sides of said opening, said hinges having aligned apertures therethrough spaced outwardly from said one wall;

a door of a size larger than said opening and formed in a generally pyramid configuration having a plurality of creases angularly spaced about a center point, said center point defining an apex of said pyramid configuration, said door being positioned in overlying relationship with said opening to completely cover the same with said apex disposed intermediate said hinges; and a cam rod having a central, overcentered cam between opposite end rods rotatably received in said hinge openings and a handle operatively associated with said cam so that rotation of said cam by said handle causes said cam to apply pressure to the apex of said door and through said creases to seal an outer edge of the door about said opening.

2. The closure assembly of claim 1 wherein said cam rod comprise an elongate rod double bent at each side between a center point and ends defining said end rods, a portion of said rod between said bends defining said cam.

3. The closure assembly of claim 1 further comprising a pressure pad in the form of a plate secured to said door at said apex to be acted upon by said cam.

4. The closure assembly of claim 1 further comprising a pair of retaining brackets secured to said door on opposite sides of said apex for retaining said cam rod with said door with said cam disposed between said retaining brackets.

5. The closure assembly of claim 1 wherein an outer periphery of said door is generally square.

6. In an enclosure having walls defining an interior space and an access opening through one wall providing access to said space, a closure assembly comprising:

a pair of hinges mounted to said one wall on opposite sides of said opening, said hinges having aligned apertures therethrough spaced outwardly from said one wall;

a rectangular door of a size larger than said opening and formed in a generally pyramid configuration having four creases, each extending from said center point to one corner of said door, said center point defining an apex of said pyramid configuration, each side edge of said door between adjacent corners having a downward convex curve, said door being positioned in overlying relationship with said opening to completely cover the same with said apex disposed intermediate said hinges; and a cam rod having a central, overcentered cam between opposite end rods rotatably received in said hinge openings and a handle operatively associated with said cam so that rotation of said cam by said handle causes said cam to apply pressure to the apex of said door and through said creases to the curved side edges to provide an even seal of the door about said opening.

7. The closure assembly of claim 6 wherein said cam rod comprise an elongate rod double bent at each side between a center point and ends defining said end rods, a portion of said rod between said bends defining said cam.

8. The closure assembly of claim 6 further comprising a pressure pad in the form of a plate secured to said door at said apex to be acted upon by said cam.

9. The closure assembly of claim 6 further comprising a pair of retaining brackets secured to said door on opposite sides of said apex for retaining said cam rod with said door with said cam disposed between said retaining brackets.

10. The closure assembly of claim 6 wherein an outer periphery of said door is generally square.

11. In an enclosure having walls defining an interior space and an access opening through one wall providing access to said space, a closure assembly comprising:

a pair of hinges mounted to, said one wall on opposite sides of said opening, said hinges having aligned apertures therethrough spaced outwardly from said one wall;

a rectangular sheet metal door of a size larger than said opening and formed in a generally pyramid configuration having four creases, each extending from said center point to one corner of said door, said center point defining an apex of said pyramid configuration, each side edge of said door between adjacent corners having a downward convex curve, said door being positioned in overlying relationship with said opening to completely cover the same with said apex disposed intermediate said hinges; and a cam rod having a central, overcentered cam between opposite end rods rotatably and removably received in said hinge openings and a handle operatively associated with said cam so that rotation of said cam by said handle causes said cam to apply pressure to the apex of said door and through said creases to the curved side edges to provide an even seal of the door about said opening.

12. The closure assembly of claim 11 wherein said cam rod comprise an elongate rod double bent at each side between a center point and ends defining said end rods, a portion of said rod between said bends defining said cam.

13. The closure assembly of claim 11 further comprising a pressure pad in the form of a plate secured to said door at said apex to be acted upon by said cam.

14. The closure assembly of claim 11 further comprising a pair of retaining brackets secured to said door on opposite sides of said apex for retaining said cam rod with said door with said cam disposed between said retaining brackets.

15. The closure assembly of claim 11 wherein an outer periphery of said door is generally square.

* * * * *